US010369082B2

(12) United States Patent
Dedvukaj et al.

(10) Patent No.: US 10,369,082 B2
(45) Date of Patent: Aug. 6, 2019

(54) BOTTLE HOLDER AND ACCESSORY FOR A MOBILE DEVICE

(71) Applicants: Paul Dedvukaj, White Plains, NY (US); Eric Chan, New York, NY (US); Michael Morath, New York, NY (US); Christopher Hable, Erlangen (DE)

(72) Inventors: Paul Dedvukaj, White Plains, NY (US); Eric Chan, New York, NY (US); Michael Morath, New York, NY (US); Christopher Hable, Erlangen (DE)

(73) Assignee: Paul Dedvukaj, White Plains, NY (US)

( * ) Notice: Subject to any disclaimer, the term of this patent is extended or adjusted under 35 U.S.C. 154(b) by 0 days.

(21) Appl. No.: 15/871,647

(22) Filed: Jan. 15, 2018

(65) Prior Publication Data

US 2018/0228697 A1 Aug. 16, 2018

Related U.S. Application Data

(60) Provisional application No. 62/458,279, filed on Feb. 13, 2017.

(51) Int. Cl.

| | |
|---|---|
| ***A47D 15/00*** | (2006.01) |
| ***A61J 9/06*** | (2006.01) |
| ***A45F 5/00*** | (2006.01) |

(52) U.S. Cl.

CPC ..... *A61J 9/0661* (2015.05); *A45F 5/00* (2013.01); *A61J 9/06* (2013.01); *A45F 2005/002* (2013.01); *A45F 2200/0516* (2013.01); *A45F 2200/0525* (2013.01); *A45F 2200/0583* (2013.01); *A61J 9/0607* (2015.05); *A61J 9/0692* (2015.05)

(58) Field of Classification Search

CPC ..... B60R 11/0241; B60R 11/0258; A61J 9/0661; A45F 5/00; A45F 2005/002

USPC ..... 248/229.1, 229.15, 104

See application file for complete search history.

(56) References Cited

U.S. PATENT DOCUMENTS

| | | | | |
|---|---|---|---|---|
| 1,688,765 | A * | 10/1928 | Veras | A61J 9/0638 224/409 |
| D462,775 | S * | 9/2002 | Minor | D24/199 |
| 8,777,171 | B2 * | 7/2014 | Gainey, Jr. | G01N 1/2214 248/226.11 |
| 9,206,943 | B2 * | 12/2015 | Chang | A45B 3/00 |
| D788,081 | S * | 5/2017 | Austin-Smith | D14/226 |
| 2017/0072872 | A1 * | 3/2017 | Balmer | F16M 13/022 |

* cited by examiner

*Primary Examiner* — Todd M Epps

(74) *Attorney, Agent, or Firm* — Leason Ellis LLP

(57) ABSTRACT

A bottle holder and accessory for holding a mobile device includes a first part having a first clamp at a first end that is configured to receive and grasp a bottle. The first part has a stem at an opposite second end and a first arm that is pivotally coupled to the stem. A holder that is configured to hold the mobile device. The holder is pivotally coupled to the first arm.

18 Claims, 9 Drawing Sheets

BOTTLE HOLDER AND ACCESSORY FOR A MOBILE DEVICE

CROSS-REFERENCE TO RELATED PATENT APPLICATIONS

This application is based on and claims priority to U.S. Provisional Patent Application 62/458,279, filed Feb. 13, 2017, the entire contents of which is incorporated by reference herein as if expressly set forth in its respective entirety herein.

TECHNICAL FIELD

The present invention generally relates to a bottle holder (e.g., baby bottle) and accessory for a mobile device (e.g., smartphone) and more particularly, the present invention relates to a bottle holder that is configured to be detachably coupled to a bottle and has a portion that is configured to hold a mobile device (e.g., smartphone) in an orientation in which a display screen thereof faces an opening of the bottle so as to allow viewing of the display screen while drinking.

BACKGROUND

During the initial early months of an infant's life, nourishment is obtained by either breast feeding or by bottle feeding. Even when breast feeding is the chosen primary method of feeding the infant (baby), many mothers are required to pump and store the breast milk due to certain constraints, such as work schedule, etc. Thus, most infants feed from a bottle that contains either breast milk or formula. While there are many different types of bottles, the bottles all for the most part include a soft, flexible teat (nipple). Teats come in a selection of flow rates that are marketed based on the age of the infant. Different flow rate teats either have more holes or larger holes.

While the amount of time it takes for the infant to drink the contents of the bottle depends on a number of factors, such as the age and size of the infant, etc., it is a significant amount of time during which the infant is typically held or supported by the parent or caregiver. For example, for a newborn to 3 months, a recommended bottle feeding time is 20-40 minutes; for babies 3 months to 6 months it is 15-30 minutes; and babies over 6 months it is 10-20 minutes.

Due to the amount of time that the baby is latching onto the bottle, the baby can be become tired and distracted. There is therefore a perceived need to provide an accessory that can entertain the baby during the time the baby is latched onto the bottle for feeding.

SUMMARY

Throughout the specification, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. Similarly, the phrase "one or more embodiments" as used herein does not necessarily refer to the same embodiment and the phrase "at least one embodiment" as used herein does not necessarily refer to a different embodiment. The intention is, for example, that claimed subject matter includes combinations of example embodiments in whole or in part.

A bottle holder and accessory for holding a mobile device includes a first part having a first clamp at a first end that is configured to receive and grasp a bottle. The first part has a stem at an opposite second end. The accessory also includes a second part that includes a center body and a second clamp at a first end of the center body and a third clamp at an opposite second end of the center body. The stem is received within the second clamp so as to couple the first part to the second part. The third clamp is rotatable relative to the center body and is configured to grasp and hold the mobile device to permit viewing of a display screen by the baby drinking from the bottle.

In accordance with one embodiment, a bottle holder and accessory for holding a mobile device includes a first part having a first clamp at a first end that is configured to receive and grasp a bottle. The first part has a stem at an opposite second end and a first arm that is pivotally coupled to the stem. A holder that is configured to hold the mobile device. The holder is pivotally coupled to the first arm.

In accordance with another embodiment, a bottle holder and accessory for holding a mobile device includes a flexible clamp that is configured to receive and grasp a bottle. The mobile device includes a first arm that is pivotally and rotationally coupled to the flexible clamp at a first end of the first arm. The mobile device includes a holder that is configured to hold the mobile device. The holder is pivotally coupled to a second end the first arm. The holder is movable between a fully retracted position in which the holder nests with the first arm and an extended position in which the holder is spaced from the first arm. The holder has a first part and a second part that is biased and movable relative to the first part that is pivotally coupled to the second end of the first arm. The first part and the second part are configured to hold and retain the mobile device.

BRIEF DESCRIPTION OF THE DRAWING FIGURES

The invention is illustrated in the figures of the accompanying drawings which are meant to be exemplary and not limiting, in which like references are intended to refer to like or corresponding parts, and in which.

DETAILED DESCRIPTION OF CERTAIN EMBODIMENTS

Figure 1:
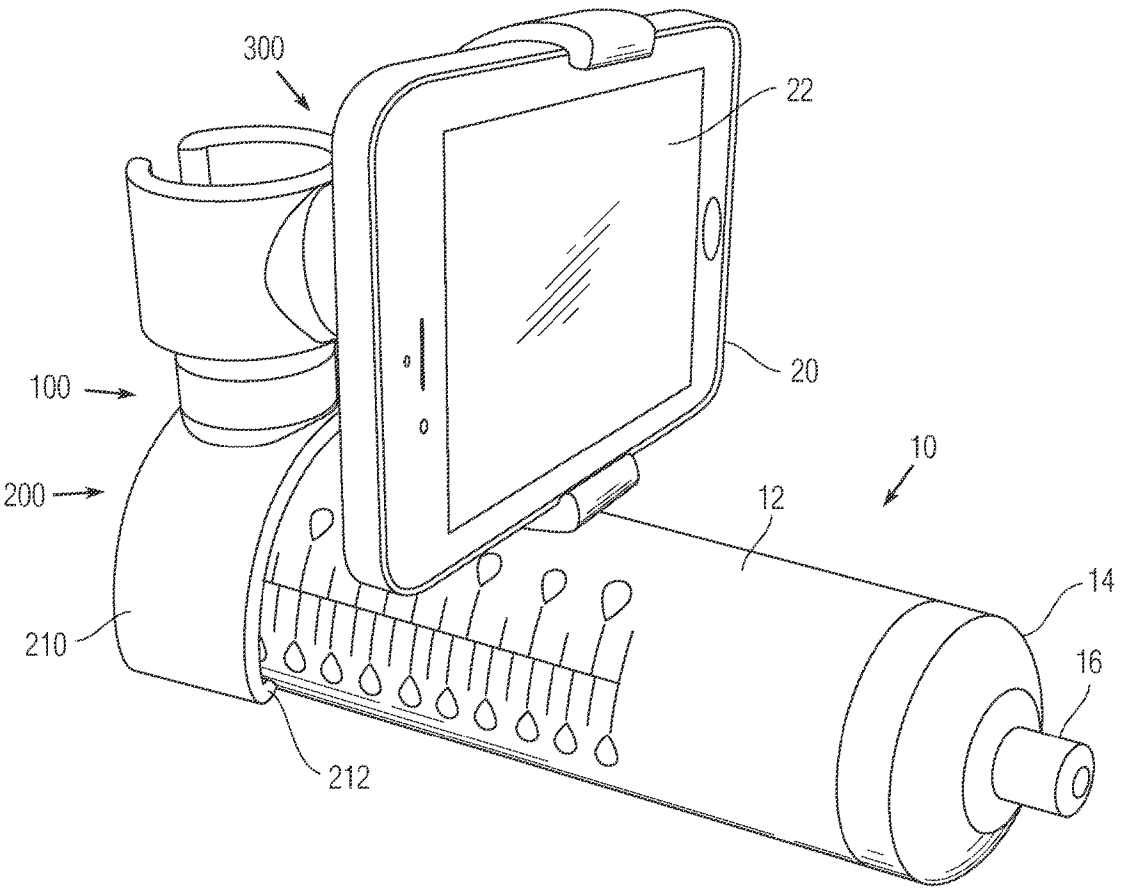
FIG. 1 is a side and front perspective view of a bottle holder and accessory for a mobile device (e.g., smartphone) coupled to a bottle with the mobile device display being in a landscape orientation.
Figure 2:
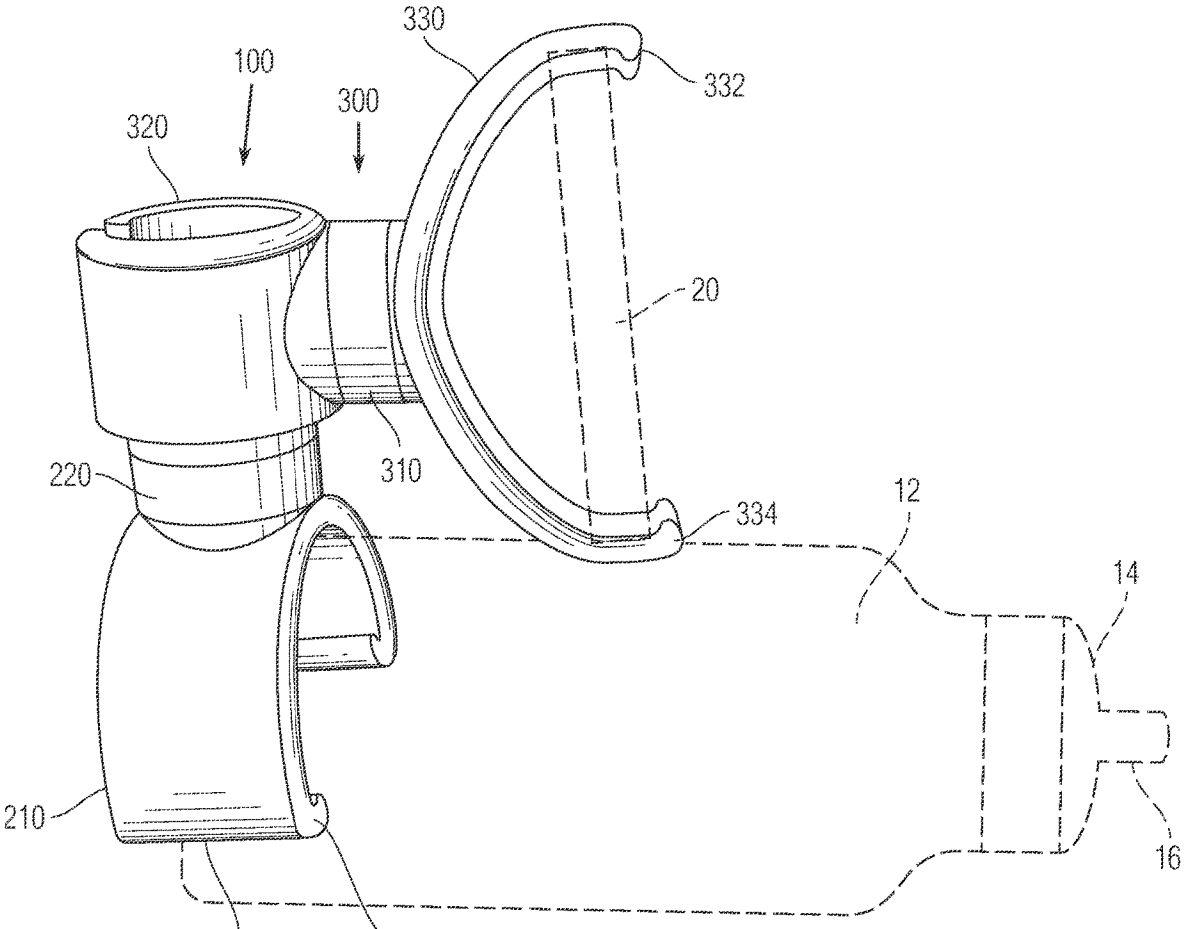
FIG. 2 is a side perspective view thereof.
Figure 3:
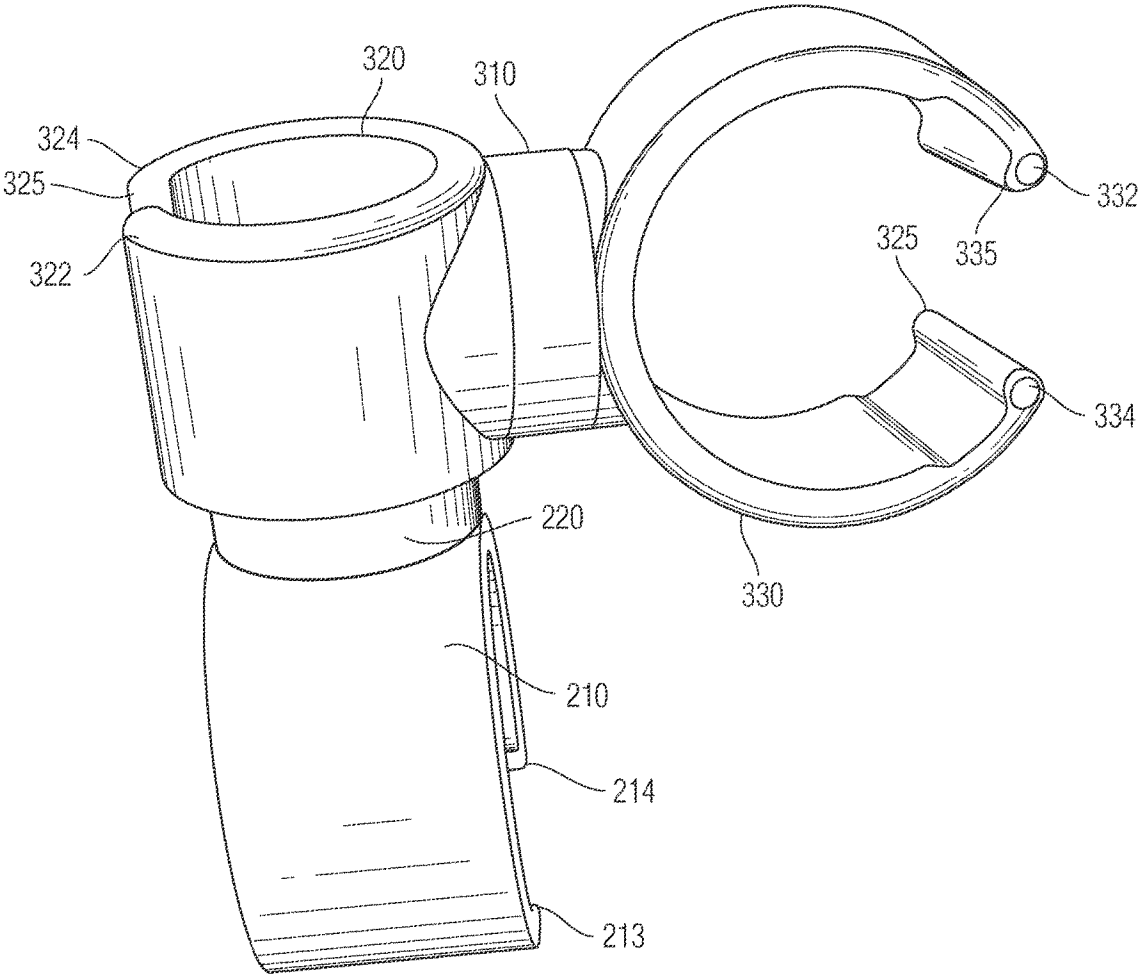
FIG. 3 is a side perspective view thereof without the bottle.
Figure 4:
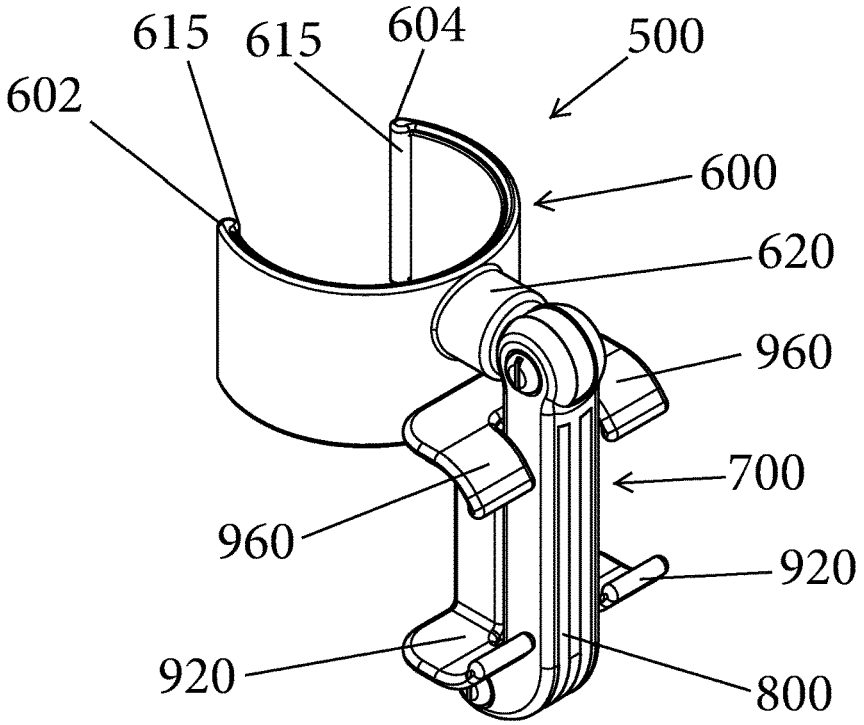
FIG. 4 is a first perspective view of a bottle holder and accessory for a mobile device (e.g., smartphone) according to another embodiment and being configured for coupling to a bottle and shown in a fully retracted position.
Figure 5:
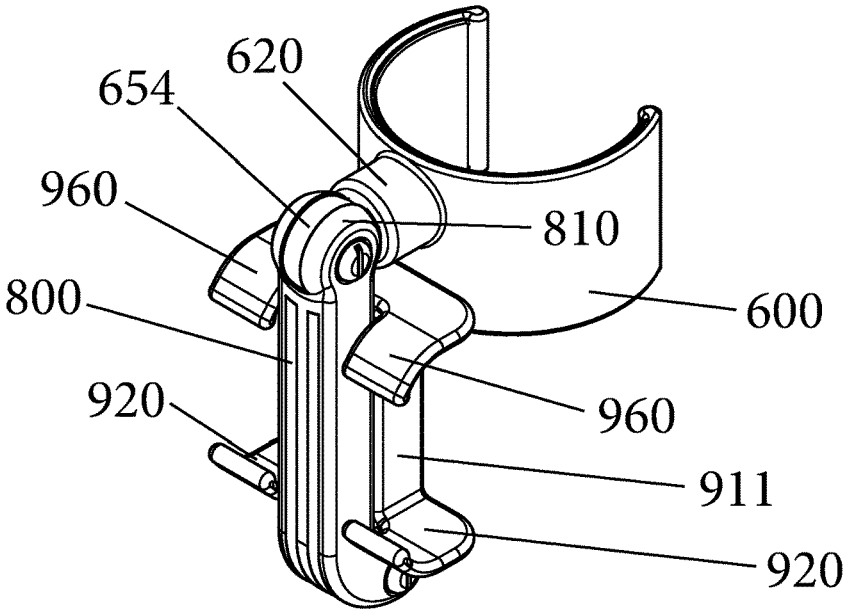
FIG. 5 is a second perspective view thereof.
Figure 6:
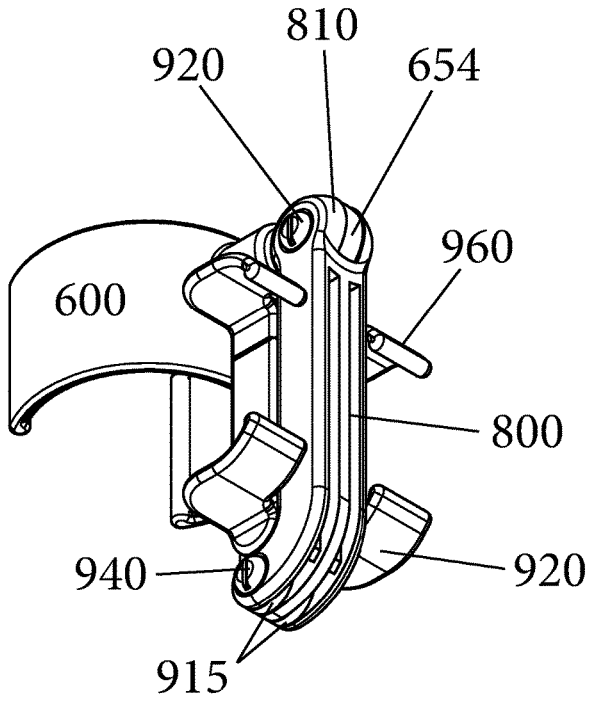
FIG. 6 is a third perspective view thereof.
Figure 7:
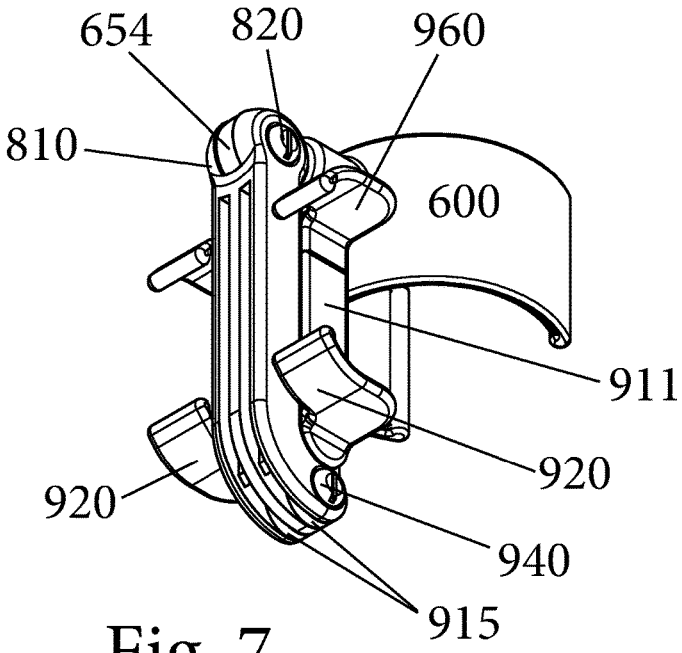
FIG. 7 is a fourth perspective view thereof.
Figure 8:
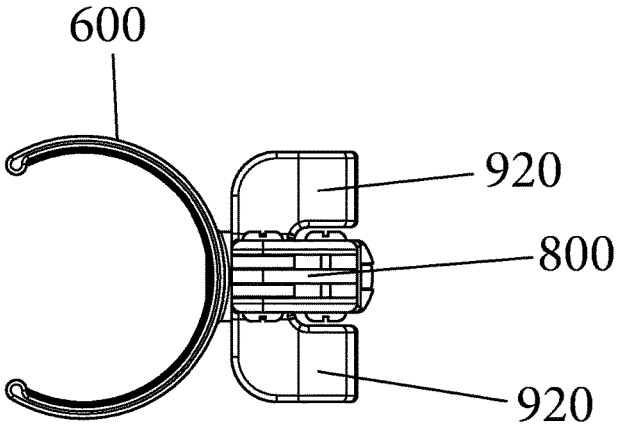
FIG. 8 is a first plan view thereof.
Figure 9:
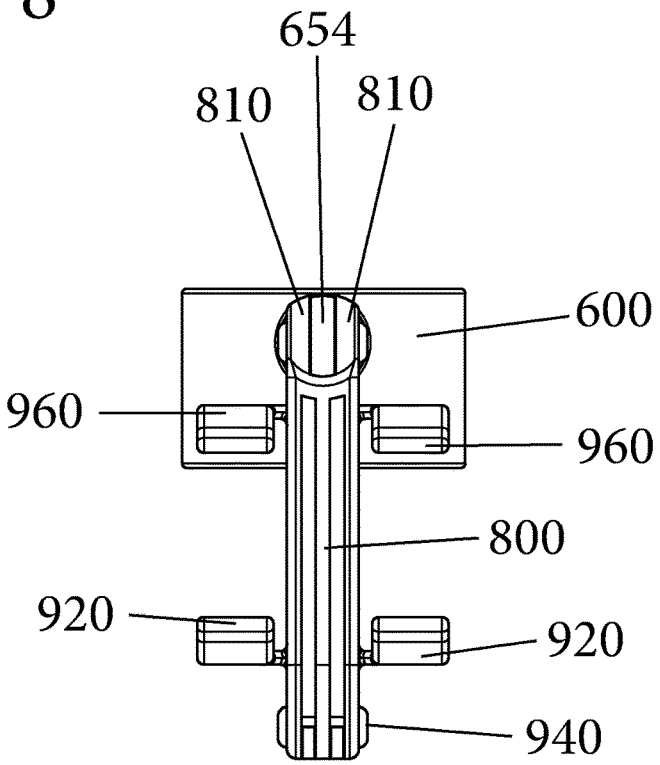
FIG. 9 is a front elevation view thereof.
Figure 10:
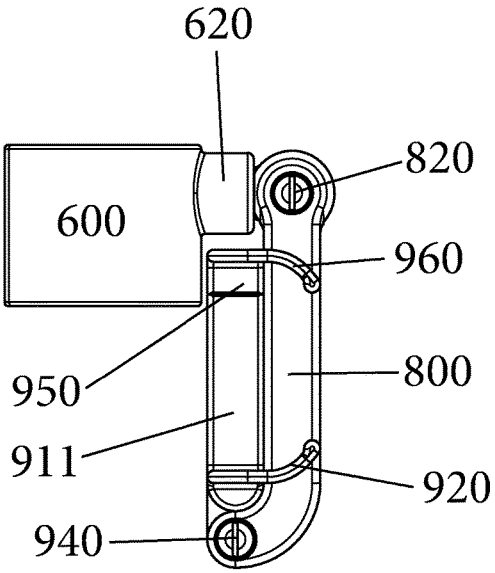
FIG. 10 is a side elevation view thereof.
Figure 11:
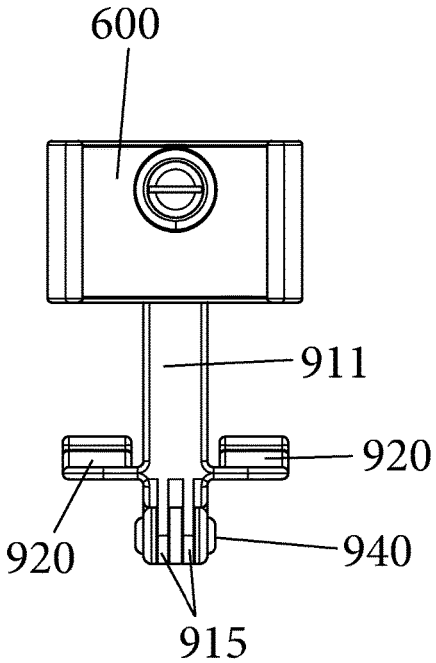
FIG. 11 is a rear elevation view thereof.
Figure 12:
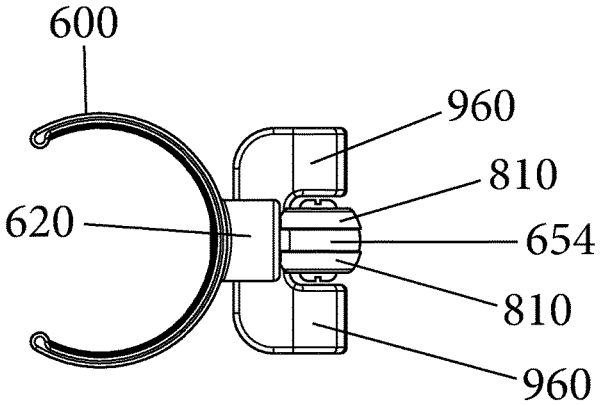
FIG. 12 is a second plan view thereof.
Figure 13:
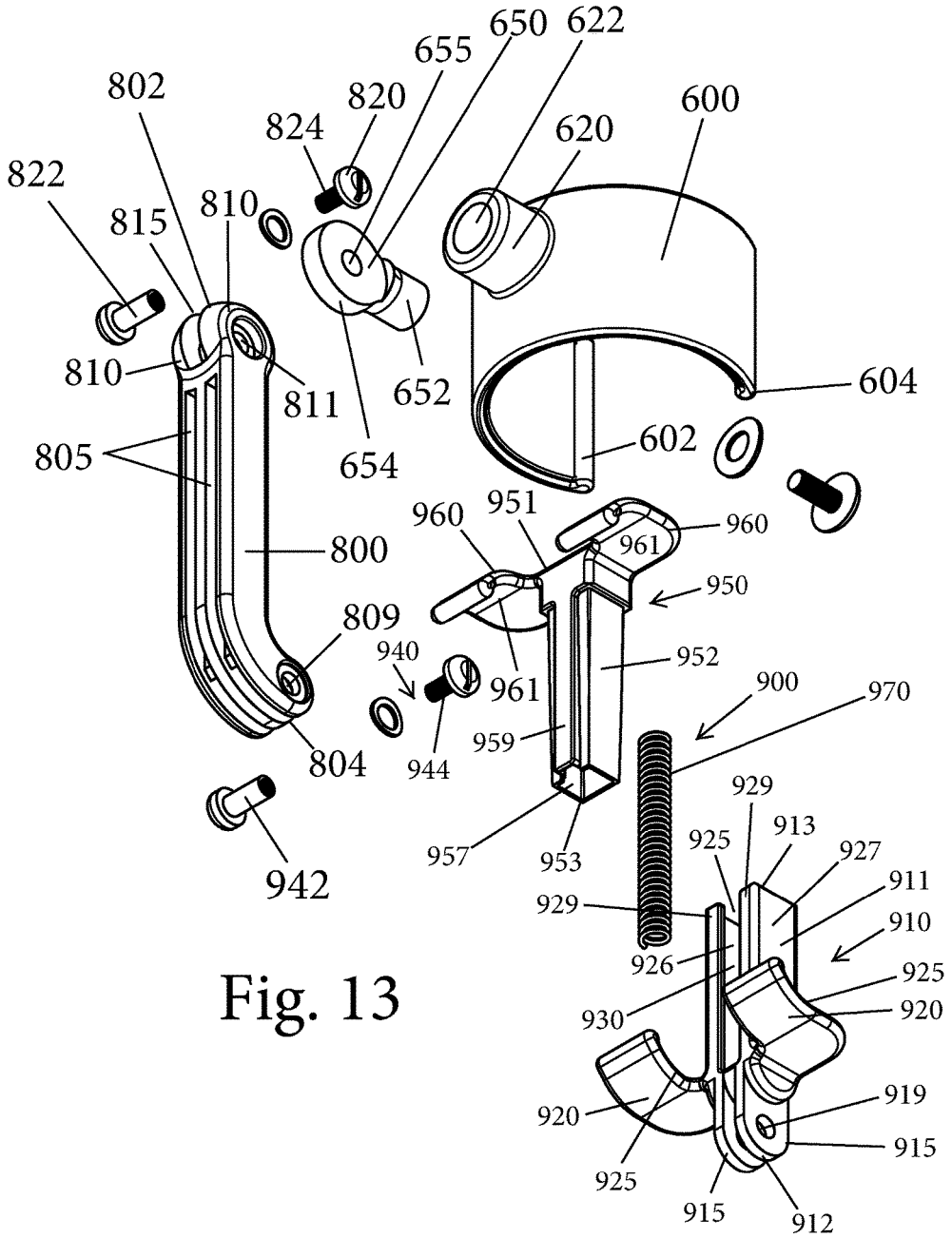
FIG. 13 is an exploded view of the accessory of FIG. 4.

FIGS. 1-3 illustrate a bottle holder and accessory for smartphone ("bottle holder accessory") 100 for use with a bottle 10 and a mobile device 20. Bottle 10 is a baby holder that has a bottle body 12 and a cap 14 in which a teat 16 is provided. The mobile device 20 can take any number of different forms including but not limited to a tablet, smartphone, etc. The mobile device 20 includes a display screen 22 which extends lengthwise. The display screen 22 can be viewed in a vertical orientation (not shown) or in a landscape orientation (FIG. 1).

The bottle holder accessory 100 is configured to be detachably coupled to bottle 10 and also is configured to receive and hold the mobile device 20. The bottle holder accessory 100 can be thought of as being formed of a first part 200 that is coupled to a second part 300. The first part 200 is configured to be detachably coupled to bottle 10, while the second part 300 is configured to receive and hold the mobile device 20.

The first part 200 has a first clamp 210 formed at a first end 202 of the first part 200 and further includes a stem 220 formed at a second end of the first part 200. The first clamp 210 is configured to grasp onto and hold the bottle 10. The first clamp 210 can be in the form of a flexible, extendable C-shaped clamp having a first end 212 and an opposite second end 214.

When a force is applied, the ends 212, 214 of the clamp 210 can be expanded outward so as to increase the distance between the ends 212, 214 to allow for reception of the bottle 10 therebetween. The clamp 210 is thus formed of a resilient material that can flex but has a return force such that once the applied force needed to flex the clamp 210 open is removed, the clamp 210 returns to its original rest position. Separation of the ends 212, 214 of the clamp 210 thus generates a biasing force. The end portions of the clamp 210 can thus be thought of as jaws that act to hold the bottle 10 in place. The clamp 210 is sized such that in the rest position, the bottle 10 cannot fit within the clamp 210. Instead, to insert the bottle 10 into the clamp 210, the ends 212, 214 of the clamp 210 are pulled apart from one another. The separation of the ends 212, 214 generates a biasing return force (due to the characteristics (material) of the clamp 210) and thus, after insertion of the bottle 10 into the open space of the clamp 210 between the ends 212, 214, the ends 212, 214 are let go and the biasing return force causes the grasping of the bottle 10 within the clamp 210.

As shown in the figures, each of the ends 212, 214, has an enlarged retaining rib 215. The rib 215 extends the entire width of the end 212, 214. As shown, the rib 215 can have a rounded shape.

As shown, the clamp 210 does not completely encircle the bottle 10 but instead only partially encircles the bottle 10. As shown in the figures, the clamp 210 extends about half way around the circumference of the bottle 10. To release the bottle 10 from the clamp 210, the ends 212, 214 of the clamp 210 are pulled a sufficient distance apart to allow for removal of the clamp 210.

The clamp 210 can be a multi-layered structure in that it can be formed of a substrate material, such as a metal or plastic, with a foam or rubber coating. Each of the clamps disclosed herein can be formed of a substrate in the form of a high quality spring steel sheet with a high quality soft apron formed thereon.

The stem 220 can be a cylindrical shaped part. The stem 220 can be formed as a cylindrical shaped plastic piece that extends outwardly from the clamp 210 and as shown, intersects the clamp 210 at a midpoint thereof. The stem 220 can be integrally formed with the clamp 210. The stem 220 can have a diameter that is equal to or slightly less than a width of the clamp 210.

The second part 300 includes a center body 310 with a second clamp 320 at a first end of the center body 310 and a third clamp 330 at a second end of the center body 310. The second and third clamps 320, 330 can have the same size or can have different sizes. As described herein, at least the third clamp 330 can be rotatable relative to the center body 310 to allow the third clamp 330 to be placed into any number of different positions (including portrait and landscape orientations). The second clamp 320 can be fixed relative to the center body 310; however, as described herein, the entire second part 300 can rotate relative to and about the stem 220.

As with the first clamp 210, each of the second clamp 320 and the third clamp 330 can be C-shaped clamps. The second clamp 320 is configured to grasp onto and be retained about the stem 220. The second clamp 320 can be in the form of a flexible, extendable C-shaped clamp having a first end 322 and an opposite second end 324.

When a force is applied, the ends 322, 324 of the second clamp 320 can be expanded outward so as to increase the distance between the ends 322, 324 to allow for reception of the stem 220 therebetween. The second clamp 320 is thus formed of a resilient material that can flex but has a return force such that once the applied force needed to flex the second clamp 320 open is removed, the second clamp 320 returns to its original rest position. Separation of the ends 322, 324 of the second clamp 320 thus generates a biasing force. The end portions of the clamp 320 can thus be thought of as jaws that act to couple and hold the second part 300 to the stem 220, thereby attaching the first and second parts 200, 300 to one another. The second clamp 320 is sized such that in the rest position, the stem 220 cannot fit within the second clamp 320. Instead, to insert the stem 220 into the second clamp 320, the ends 322, 324 of the second clamp 320 are pulled apart from one another. The separation of the ends 322, 324 generates a biasing return force and thus, after insertion of the stem 220 into the open space of the second clamp 320 between the ends 322, 324, the ends 322, 324 are let go and the biasing return force causes the grasping of the stem 220 within the second clamp 320.

The coupling between the second clamp 320 and the stem 220 is such that upon application of force, the second part 300 can be rotated about the stem 220 so as to alter the location of the second part 300 relative to the first part 200.

As shown in the figures, each of the ends 222, 324, has an enlarged retaining rib 325. The rib 325 extends the entire width of the end 312, 314. As shown, the rib 325 can have a rounded shape.

The third clamp 330 is configured to grasp onto and hold the mobile device 20. The third clamp 330 can be in the form of a flexible, extendable C-shaped clamp having a first end 332 and an opposite second end 334.

When a force is applied, the ends 332, 334 of the third clamp 330 can be expanded outward so as to increase the distance between the ends 332, 334 to allow for reception of the mobile device 20 therebetween. The third clamp 330 is thus formed of a resilient material that can flex but has a return force such that once the applied force needed to flex the third clamp 330 open is removed, the second clamp 320 returns to its original rest position. Separation of the ends 322, 324 of the third clamp 330 thus generates a biasing force. The end portions of the clamp 330 can thus be thought of as jaws that act to clamp the mobile device 20 such that it is suspended and carried by the third clamp 330. The third clamp 330 is sized such that in the rest position, the mobile device 20 cannot fit within the third clamp 330. Instead, to insert the mobile device 20 into the third clamp 330, the ends 332, 334 of the third clamp 330 are pulled apart from one another. The separation of the ends 332, 334 generates a biasing return force and thus, after insertion of the mobile device 20 into the open space of the third clamp 330 between the ends 332, 334, the ends 332, 334 are let go and the biasing return force causes the grasping of the mobile device 20 within the third clamp 330.

As illustrated, the third clamp 330 can freely rotate relative to the center body 310. The rotation of the third clamp 330 about the center body 310 allows the mobile device 20 to be held in either a vertical (portrait) orientation (FIG. 3) or a landscape (horizontal) orientation (FIG. 1). The third clamp 330 is thus rotatably coupled to the center body 310.

As shown in the figures, each of the ends 332, 334, has an enlarged retaining rib 335. The rib 335 extends the entire width of the end 332, 334. As shown, the rib 335 can have a rounded shape.

FIG. 1 shows the accessory 100 attached to the bottle 10 with the mobile device 20 disposed in a landscape orientation. To place the mobile device 20 in a portrait orientation, the third clamp 330 is rotated until the mobile device 20 assumes such portrait orientation.

FIGS. 1-2 show the mobile device 20 in a position in which the display screen faces the baby that is latched onto the bottle 10. It will also be appreciated that the accessory 100 of the present invention is also configured to allow the parent or caregiver to view the display screen of the mobile device 20. To move between the orientation of FIGS. 1-2 and that of where the display screen faces the caregiver, the second part 300 is rotated about the stem 220 and the third clamp 330 is rotated to the desired position.

The accessory 100 thus provides a versatile apparatus that can be easily grasped onto the bottle 10 and easily holds the mobile device 20 in a multitude of different positions to allow either the baby or even the parent or caregiver to view and watch the display.

FIGS. 4-14 illustrate a bottle holder and accessory for smartphone ("bottle holder accessory") 500 for use with the bottle 10 (FIG. 1) and the mobile device 20 (FIG. 1). The display screen 22 can be viewed in a landscape orientation.

The bottle holder accessory 500 is configured to be detachably coupled to bottle 10 and also is configured to receive and hold the mobile device 20. The bottle holder accessory 500 can be thought of as being formed of a first part 600 that is coupled to a second part (second assembly) 700. The first part 600 is configured to be detachably coupled to bottle 10, while the second part 700 is configured to receive and hold the mobile device 20.

The first part 600 comprises a clamp, such as a C-shaped clamp (C clamp), that has a first free end 602 and an opposing second free end 604. As shown in the figures, each of the ends 602, 604, has an enlarged retaining rib 615. The rib 615 extends the entire width of the end 602, 604. As shown, the rib 615 can have a rounded shape.

At an intermediate section of the first part (clamp) 600, a stem 620 is formed. The stem 620 has a tubular shape with a hollow interior 622. The stem 620 can thus be formed at the apex of the arcuate shaped intermediate section of the first part 600. An axis through the hollow interior 622 of the stem 620 is generally perpendicular to the C-shaped clamp body.

As with the first clamp 200, the clamp 600 is configured to grasp onto and hold the bottle 10. The clamp 600 is thus formed of a flexible material that allow the C-shaped clamp body to flex open to allow reception of the bottle 10 and then when released, the C-shaped clamp body closes about the bottle 10 so as to be securely attached thereto. Since the C-shaped clamp body can be thought of as being a biased structure, when the C-shaped clamp body is opened by pulled the ends away from one another, energy is stored such that when the C-shaped clamp body is released, the ends move back toward one another and apply a biasing force to the bottle 10 that is captured between the ends 602, 604 of the C-shaped clamp body.

The second part 700 that is configured to hold the mobile device 20 is pivotally coupled to the clamp (first part) 600. For example, a first connector 650 can serve to connect the second part 700 to the clamp 600. The illustrated first connector 650 comprises a D-connector. The D-connector 650 has a first portion 652 that has a cylindrical shape and a second portion 654 that is annular shaped and includes a center hole 655 formed therethrough. The first portion 652 is sized and shaped to be received within the hollow interior 622 of the stem 620.

The first portion 652 of the first connector 650 thus provides rotatability of the clamp 600 relative to the second part (assembly) 700.

The second part 700 includes a first arm 800 that has a first end 802 and an opposing second end 804. The first end 802 of the first arm 800 is configured to receive and mate with second portion 654 of the first connector 650. More particularly, the first end 802 is of a split finger design in that there are a pair of rounded fingers 810 with a space 815 formed therebetween. The space 815 is sized to receive the second portion 654 so as to form an articulating joint between the clamp 600 and the first arm 800. Each of the rounded fingers 810 includes a first through (center) hole 811 that is axially aligned with the center hole 655 of the second portion 654. A first fastener 820 is used to couple the first arm 800 to the to the clamp 600. The first fastener 820 passes through the axially aligned holes 811, 655 and can be in the form of a screw having a threaded screwpost 822 and a screw 824 that mates with the screwpost 822. The heads of the screwpost 822 and screw 824 can be countersunk in the external faces of the rounded fingers 810. As mentioned, the coupling provided by the first fastener 820 allows for rotation of the first arm 800 relative to the clamp 600.

The body of the first arm 800 can be slotted as shown in the figures in that one or more slots 805 can be formed in the first arm 800 and extend longitudinally along a length of the first arm 800.

The second end 804 is a curved end such that as shown, the second end 804 curls out of the plane of the remaining portion of the first arm. The one or more slots 805 also extend along the curved portion of the first arm 800. At the second end 804, a second through hole 809 is formed and extends across (transverse) the second end 804. Similar to the first end 802, the second end 804 includes a pair of slots 815 that in effect are defined between a plurality of spaced apart fingers 807. In the illustrated embodiment, there are three spaced apart fingers 807 the define the pair of slots 815. The second through hole 809 passes through the three fingers 807.

The second part 700 also includes a holder 900 that is pivotally coupled to the second end 804 of the first arm 800. The holder 900 is formed of a first part 910 and a second part 950 that is biased relative to the first part 910. The first part 910 has a main portion 911 that has a first end 912 and an opposing second end 913 and can be a generally linear structure. The first end 912 has a split fingered construction and is defined by a pair of spaced apart fingers (extensions) 915 with a space 913 formed therebetween. The fingers 915 have a third through hole 919 that passes through each of the fingers 915 to define an axially aligned hole.

The first part 910 has a pair of first cradles 920 that serve to cradle one edge of the mobile device 20. Each of the first cradles 920 is located along one side of the main portion 911 of the first part 911 and can have a concave surface 925 which serves to receive and hold the mobile device 20.

Extending from the pair of first cradles 920 to the second end 913, the main portion 911 has a hollow center 925 that is defined by a pair of side walls 926, 927, a rear wall 928 and a partial front wall 929. Unlike the other walls, the front wall 929 is not a complete wall extending between the two side walls 926, 927 but includes a center longitudinal slot 930. In the illustrated embodiment, the side walls 926, 927, rear wall 928 and partial front wall 929 define a square shaped structure.

The second part 950 is complementary to the first part 910 and in combination with the first part 910, the second part 950 serves to hold and cradle an opposite edge of the mobile device 20. The second part 950 has a first end 951 and an opposing second end 953. The second part 950 has an elongated main portion 952 that comprises a hollow part and is configured to be received within the hollow center 925 of the main portion 911 of the first part 910. The illustrated elongated main portion 952 thus has a hollow interior 957 and is generally square shaped. The elongated main portion 952 also includes a front protrusion or ridge 959 that is formed along the front wall of the elongated main portion 952. As shown, the front protrusion 959 can be a linear protrusion that is formed centrally along the front wall. The front protrusion 959 is configured to be received within the center longitudinal slot 930 and the other wall section of the elongated main portion 952 being seated against inner surfaces of the corresponding walls of the main portion 911.

At the first end 951, a pair of second cradles 960 are formed. The pair of second cradles 960 are similar or identical to the pair of first cradles 920 and are formed on both sides of the elongated main portion 952. Each of the second cradles 960 has a concave surface 961 which serves to receive and hold the mobile device 20. The pair of second cradles 960 thus faces the pair of first cradles 920, with the second cradles 960 being spaced apart from the first cradles 920. The first and second parts 910, 920 are coupled to one another such that the concave surfaces 925, 961 face one another.

The second part 950 is biased relative to the first part 910 by a biasing element 970 that is disposed within the hollow interiors 925, 957 of the first part 910 and the second part 950, respectively. The biasing element 970 can be in the form of a tension spring that is disposed within the hollow interiors 925, 957. Since, as described herein, the first part 910 is fixedly, yet pivotally, attached to the first arm 800, the tension spring 970 exerts a force on the second part 950 to cause the second part 950 to be biased relative to the first part 910 when the mobile device 20 is inserted between the first part 910 and the second part 950. Thus, in a rest position of the tension spring 970, the second part 950 is spaced a first distance from the first part 910. In order to generate a holding force, the second part 950 is moved in a direction away from the first part 910 resulting in the tension spring 970 storing energy (due to it becoming elongated). Thus, the second part 950 is moved a sufficient distance away from the first part 910 to allow insertion of the mobile device 20 between the first part 910 and the second part 950 (i.e., between the pair of first cradles 920 and the pair of second cradles 960). Thus, once the mobile device 20 is disposed between the pair of first cradles 920 and the pair of second cradles 960 and the user releases the second part 960, the tension spring 970 causes the second part 950 to be drawn to the first part 910. This biasing force causes the mobile device 20 to be effectively clamped between the first part 910 and the second part 950.

Figure 14:
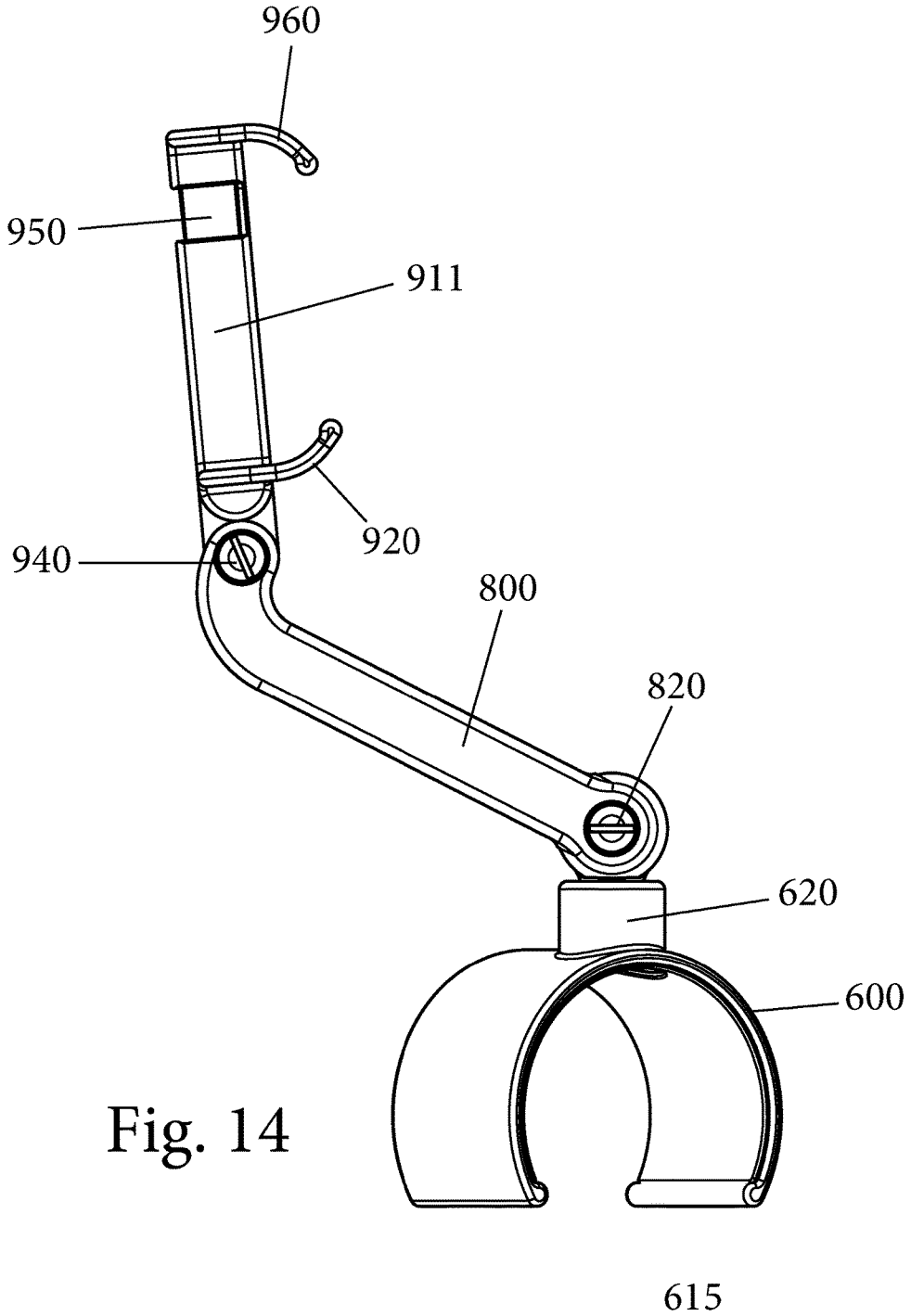
FIG. 14 is a perspective view of the accessory in an extended position.

The first part 910 is pivotally attached to the first arm 800 by inserting the fingers 912 into the slots 815 resulting in the through holes 809, 919 being axially aligned to permit insertion of a second fastener 940. The second fastener 940 can be in the form of a screw having a threaded screwpost 942 and a screw 944 that mates with the screwpost 922. The heads of the screwpost 942 and screw 944 can be countersunk in the external faces of the fingers. As mentioned, the coupling provided by the second fastener 940 allows for rotation of the first part 910 relative to the first arm 800. In other words, the first part 910 can pivot relative to the first arm 800 and more particularly, the first part 910 can move between a fully retracted (folded) position (FIGS. 4-7) and a fully extended position (FIG. 14).

As shown in FIGS. 4-7, the pair of first cradles 920 are spaced laterally apart so that the first arm 800 can be received therebetween when the first and second parts 910, 950 are in the fully folded position and similarly, the pair of second cradles 960 are spaced laterally apart so that the first arm 800 can be received therebetween when the first and second parts 910, 950 are in the fully folded position. In other words, the first cradles 920 and the second cradles 960 nest with the first arm 800. In this fully folded (retracted) position, the main portions (body) 911, 952 are generally parallel to the first arm 800. As shown, in the fully folded position, the pair of first cradles 920 lie proximate the first end 802 of the first arm 800 and the pair of second cradles 960 lie proximate the second end 804 of the first arm 800. This arrangement provides a compact design for the accessory 500.

As shown, in both the fully folded position and the extended position, the pair of first cradles 920 and the pair of second cradles 960 are disposed opposite one another and in facing relationship with respect to one another.

It will also be understood that the accessory 500 is shown in FIGS. 4-12 with a longitudinal axis of the first arm 800 being generally perpendicular to an axis passing through the center of stem 620.

FIG. 14 shows the accessory 500 in an extended position which is the in-use position. In this fully extended position, the first arm 800 is pivoted about a first pivot axis passing through the holes 655, 811 (and through the fastener 820). The second part 900 is then pivoted relative to the first arm 800 (i.e., the second part 900 pivots about a second pivot axis passing through the holes 809 (and through the fastener 940). In this extended position, it will be appreciated that the spring 970 is in its relaxed position resulting in the first part 910 and the second part 950 being spaced a first distance apart.

The accessory 500 is coupled to a bottle by inserting the bottle into the first part 600 by inserting the bottle between the ends 602, 604 to cause flexing of the first part (clamp) 600 and then clamping of the first part 600 to the bottle once the first part 600 is released. The accessory 500 is thus detachably coupled to the bottle.

The user then positions the holder 900 in the desired position as by pivoting the first arm 800 to the desired position and unfolding the holder 900 from the first arm 800. The first arm 800 and holder 900 can be rotated relative to the first part 600/the bottle.

The mobile device (e.g., phone) is then inserted into the holder 900 by separating the second part 950 to the first part 910 a second distance that is greater than the first distance and is selected to allow clearance and insertion of the mobile device between the first part 910 and the second part 950. One edge (e.g., a first side edge) of the mobile device seats against the concave surfaces 925 of the pair of first cradles 920 and another opposite edge (e.g., a second side edge) of the mobile device seats against the concave surfaces 961 of the pair of second cradles 960. The opposite pairs of cradles 920, 960 serve to securely hold the mobile device. The mobile device is generally held in a portrait orientation that is generally parallel to the main portion 911. The screen/display of the mobile device thus faces outward away from the main portion 911 and is viewable by a baby or other person who is holding the bottle.

It will be appreciated that the positions of the first arm 800 and the second part 700 can be easily and readily altered from those shown in FIG. 14 due to the pivoting movements about the first pivot axis and the second pivot axis. This allows the display screen of the mobile device to be positioned in a desired orientation relative to the clamp 600 and to the user who is holding the bottle. More specifically, the height of the mobile device relative to the clamp 600 (i.e., a distance from the holder 900 to the clamp 600) can be altered and similarly, the viewing angle of the mobile device can be altered by pivoting the holder 900 relative to the first arm 800.

It will be appreciated that the parts making up the accessory 500 can be formed from any number of suitable materials, including but not limited to plastics, metal, a combination thereof, etc.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A bottle holder and accessory for holding a mobile device comprising:

a first part having a first clamp at a first end that is configured to receive and grasp a bottle, the first part having a stem at an opposite second end;

a first arm that is pivotally coupled to the stem;

a holder that is configured to hold the mobile device, the holder being pivotally coupled to the first arm; and a first connector that pivotally and rotationally couples a first end of the first arm to the stem.

2. The bottle holder and accessory of claim 1, wherein the stem protrudes outwardly from an outer surface of the first clamp which has a C-shape.

3. The bottle holder and accessory of claim 2, wherein the stem is located at a middle portion of the first clamp located between two free ends of the first clamp.

4. The bottle holder and accessory of claim 1, wherein the first connector has a first portion that is received within a hollow interior of the stem and a second portion that has a first through hole formed therein, whereby the first connector and the first arm that is coupled thereto rotates about a first axis that passes through a center of the stem.

5. The bottle holder and accessory of claim 4, wherein the second portion comprises a flat annular shaped extension that is received between first and second fingers formed at the first end of the first arm, the first and second fingers having axially aligned first openings that align with the first through hole and a first fastener is received through the first openings and the first through hole to pivotally couple the first arm to the first connector.

6. The bottle holder and accessory of claim 5, wherein the first finger and the second finger each has a rounded shape.

7. The bottle holder and accessory of claim 1, wherein the holder is pivotally coupled to a second end of the first arm.

8. The bottle holder and accessory of claim 7, wherein the second end of the first arm is a curved end.

9. A bottle holder and accessory for holding a mobile device comprising:

a first part having a first clamp at a first end that is configured to receive and grasp a bottle, the first part having a stem at an opposite second end;

a first arm that is pivotally coupled to the stem; and a holder that is configured to hold the mobile device, the holder being pivotally coupled to the first arm;

wherein the holder includes a first part that is pivotally coupled to the first arm and a second part that is biased relative to the first part by a first biasing element.

10. The bottle holder and accessory of claim 9, wherein the first part includes a pair of first cradles and the second part includes a pair of second cradles that faces the pair of first cradles, the pair of first cradles and the pair of second cradles being configured to hold the mobile device therebetween.

11. The bottle holder and accessory of claim 10, wherein the pair of first cradles are spaced laterally apart from one another a sufficient distance such that in a folded position of the holder, the first arm is received between the pair of first cradles and wherein the pair of second cradles are spaced laterally apart from one another a sufficient distance such that in the folded position of the folder, the first arm is received between the pair of second cradles.

12. The bottle holder and accessory of claim 11, wherein in a rest position of the first biasing element, the pair of first cradles and the pair of second cradles are spaced a first distance apart which is selected to be less than a width of the mobile device.

13. The bottle holder and accessory of claim 9, wherein the first part includes a first main hollow portion having a first interior space and the second part includes a second main hollow portion having a second interior space, wherein the first biasing element is disposed within the first interior space and the second interior space.

14. The bottle holder and accessory of claim 13, wherein the first main hollow portion includes a front longitudinal slot and the second main hollow portion includes a longitudinal rail that is received within the front longitudinal slot for guiding axial movement of the second part relative to the first part.

15. The bottle holder and accessory of claim 9, wherein the first biasing element comprises a tension spring.

16. The bottle holder and accessory of claim 9, wherein the first part of the holder includes third and fourth fingers that are received between spaced fingers formed at the second end of the first arm, the third and fourth fingers having axially aligned second openings that align with third openings formed in the spaced fingers of first arm and a second fastener is received through the second openings and the third openings to pivotally couple the first arm to the first part of the holder.

17. A bottle holder and accessory for holding a mobile device comprising:

a first part having a first clamp at a first end that is configured to receive and grasp a bottle, the first part having a stem at an opposite second end;

a first arm that is pivotally coupled to the stem; and a holder that is configured to hold the mobile device, the holder being pivotally coupled to the first arm;

wherein the holder moves between a folded position and an extended position relative to the first arm.

18. A bottle holder and accessory for holding a mobile device comprising:

a flexible clamp that is configured to receive and grasp a bottle;

a first arm that is pivotally and rotationally coupled to the flexible clamp at a first end of the first arm; and a holder that is configured to hold the mobile device, the holder being pivotally coupled to a second end of the first arm, the holder being movable between a fully retracted position in which the holder nests with the first arm and an extended position in which the holder is spaced from the first arm, the holder having a first part and a second part that is biased and movable relative to the first part that is pivotally coupled to the second end of the first arm, the first part and the second part being configured to hold and retain the mobile device.

* * * * *